US005169341A

United States Patent [19]

Nakata et al.

[11] Patent Number: 5,169,341

[45] Date of Patent: Dec. 8, 1992

[54] ELECTRICAL CONNECTOR

[75] Inventors: Naohisa Nakata; Kensaku Sato, both of Tokyo, Japan

[73] Assignee: Hirose Electric Co., Ltd., Tokyo, Japan

[21] Appl. No.: 796,645

[22] Filed: Nov. 22, 1991

[30] Foreign Application Priority Data

Dec. 6, 1990 [JP] Japan ..... 2-401474[U]

[51] Int. Cl.[5] ..... H01R 13/648

[52] U.S. Cl. ..... 439/607; 439/609

[58] Field of Search ..... 439/607, 609, 608, 610, 439/95, 108

[56] References Cited

U.S. PATENT DOCUMENTS 5,035,652 7/1991 Shibano ..... 439/610

5,041,022 8/1991 Sekiguchi ..... 439/609

*Primary Examiner*—Cary F. Paumen

*Attorney, Agent, or Firm*—Kanesaka & Takeuchi

[57] ABSTRACT

An electrical connector includes a socket housing (3) having a mounting portion (8) to be mounted on a metallic panel (50), and outer and inner tubular portions (6,7) extending forwardly from the mounting portion to form a plug fitting recess (12) between them; a lock recess (13) formed on the outer tubular portion for engagement with a lock arm (45) of a connector plug (2); a contact terminal assembly (4) inserted into the inner tubular portion and having a shield jacket (24) around the contact terminal assembly, the contact terminal assembly comprising an insulation body (27) and a ground plate (30) mounted on the mounting portion such that a shield terminal (39) with a contact portion (40) is brought into contact with the shield jacket within the terminal housing.

1 Claim, 11 Drawing Sheets

ELECTRICAL CONNECTOR

BACKGROUND OF THE INVENTION

1. Field of the Invention

The present invention relates to electrical connectors for shielded cables which are used for electronic equipment or the like.

2. Description of the Prior Art

In FIG. 25, a conventional electrical connector of this type or connector socket (a) of the electrical connector includes a metallic jacket (b) in which contacts are mounted via an insulating body. This connector socket is attached to a panel (c) by fastening the flange (d) to the panel with screw (e). To connect a connector plug to this connector socket, the negative thread of the connector plug is threaded over the positive thread of the connector socket.

However, in the above connector it is necessary to thread the connector plug over the connector socket, and it is impossible to connect and disconnect the connector plug from the connector socket with a touch.

SUMMARY OF THE INVENTION

Accordingly, it is an object of the invention to provide an electrical connector socket which grounds to the equipment electromagnetic waves which cause noise.

It is another object of the invention to provide an electrical connector socket which is easy to connect and disconnect the connector plug into the connector socket with a single touch.

It is still another object of the invention to provide an electrical connector socket which is not only durable against forcible plugging in and out of the connector socket of the connector plug but also resistant against vibrations, thus suitable for use in automobile electronic equipment.

According to the invention there is provided a connector socket which includes a socket housing having a mounting portion to be mounted on a metallic panel or the like, and inner and outer tubular portions extending forwardly from the mounting portion to form a plug fitting recess between them; a lock recess formed on the outer tubular portion for engagement with a lock piece of a connector plug; a contact terminal assembly inserted into housed in the inner tubular portion and having a shield jacket; said contact terminal assembly comprising an insulation body and an electrical contact element supported by the insulation body; and a ground plate mounted on the mounting portion such that a contact portion of a shield terminal thereof is brought into contact with the shield jacket with the terminal housing.

Electromagnetic waves, which are a source of noise, are discharged through the shield braid, the shield jacket, the ground plate, and the metallic panel. It is possible to connect and disconnect the connector plug from the connector socket with a single touch because the fitting portion of the connector plug is fitted into the fitting recess of the connector socket to bring the contact terminal of the connector plug into contact with the contact portion of the connector socket while the lock arm of the connector plug is engaged with the lock recess of the connector socket for locking. The strength against the forcible plugging in and out of the connector socket of the connector plug is increased because the contact terminal is placed within the socket housing which is secured to the metallic panel. Since the lock recess which engages the lock arm of the connector plug is formed on the socket housing, the connection between the connector plug and socket is very resistant against vibrations and suitable for automotive electronic equipment.

The above and other objects, features, and advantages of the invention will be more apparent from the following description when taken in conjunction with the accompanying drawings.

DESCRIPTION OF THE PREFERRED EMBODIMENT

Figure 1:
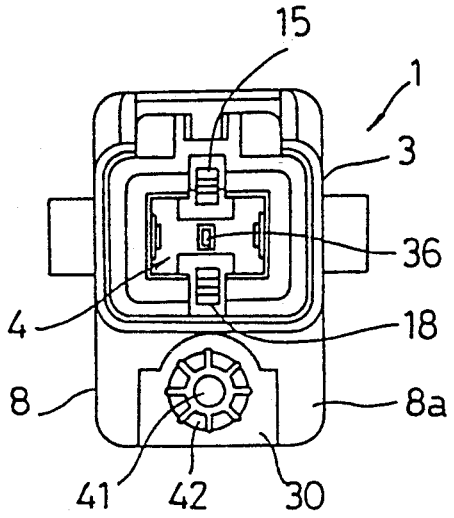
FIG. 1 is a front view of a connector socket according to an embodiment of the invention.
Figure 24:
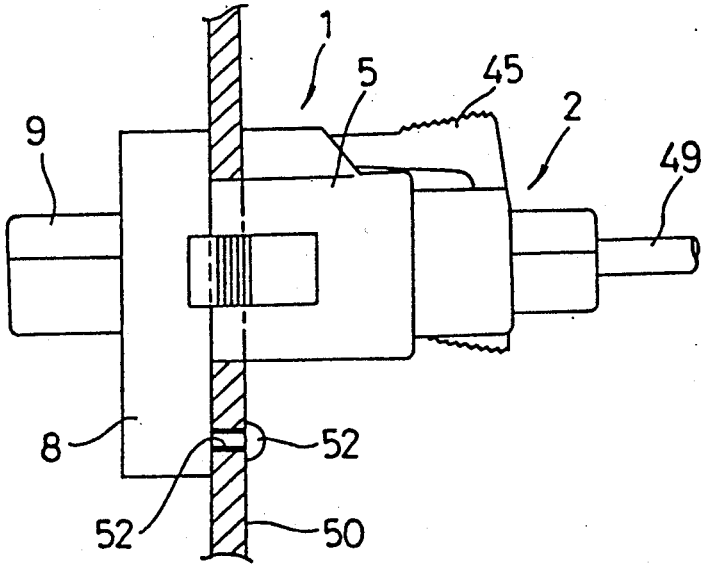
FIG. 24 is a side view showing the connection of the connector plug into the connector socket.
Figure 2:
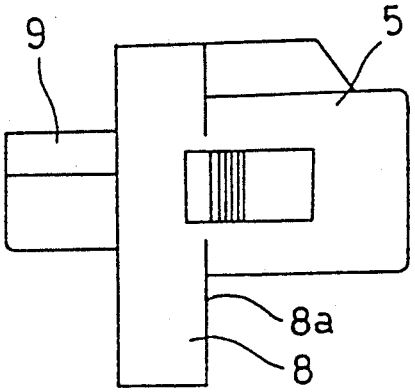
FIG. 2 is a side view of the connector socket.
Figure 3:
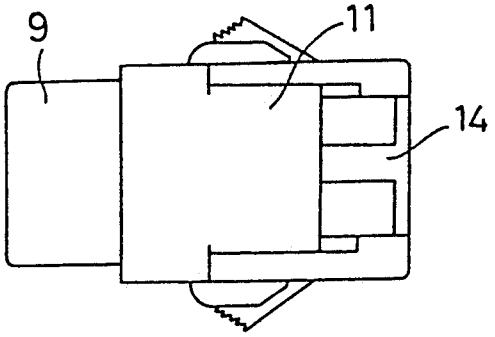
FIG. 3 is a top plan view of the connector socket.
Figure 4:
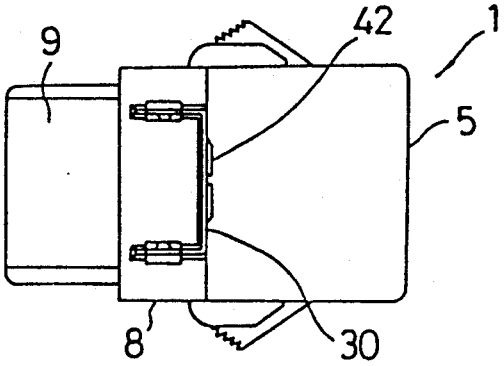
FIG. 4 is a bottom view of the connector socket.
Figure 5:
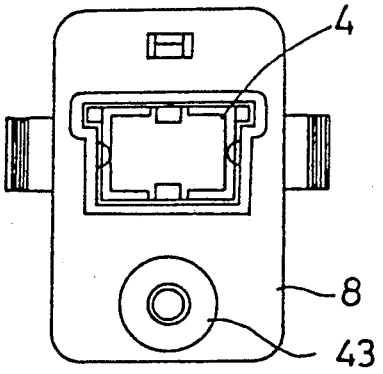
FIG. 5 is a rear view of the connector socket.
Figure 6:
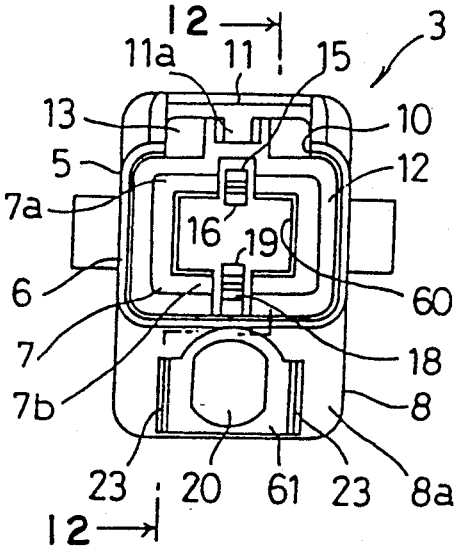
FIG. 6 is a front view of a socket housing useful for the connector socket.
Figure 7:
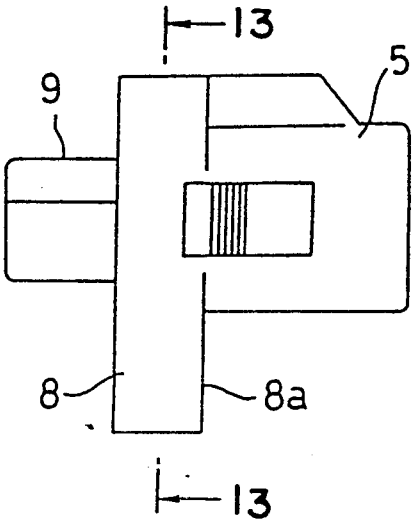
FIG. 7 is a side view of the socket housing.
Figure 8:
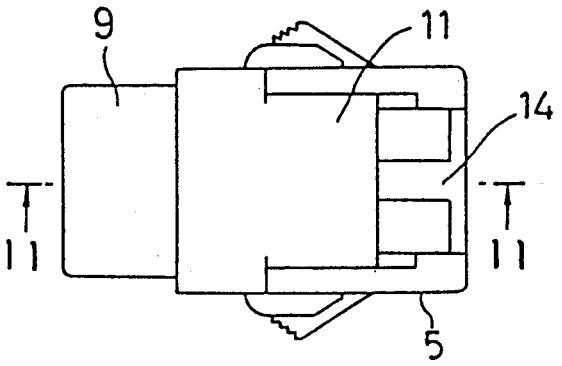
FIG. 8 is a top plan view of the socket housing.
Figure 9:
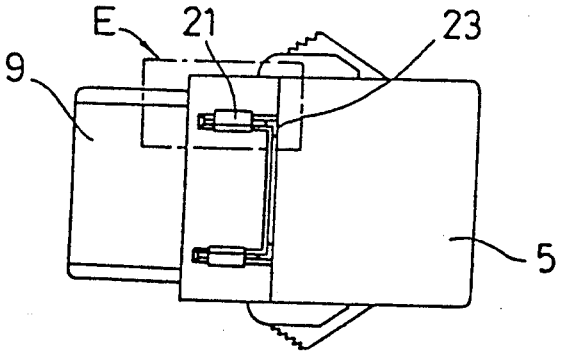
FIG. 9 is a bottom view of the socket housing.
Figure 10:
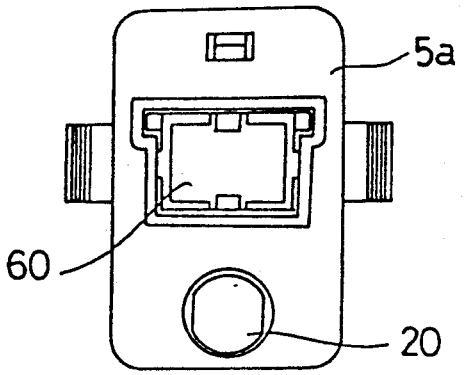
FIG. 10 is a rear view of the socket housing.
Figure 11:
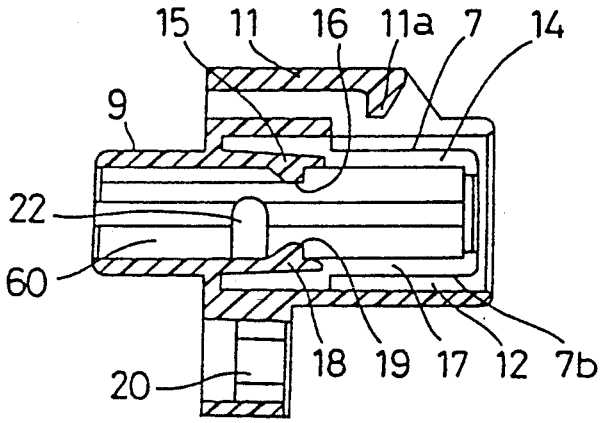
FIG. 11 is a sectional view taken along line 11—11 of FIG. 8.
Figure 12:
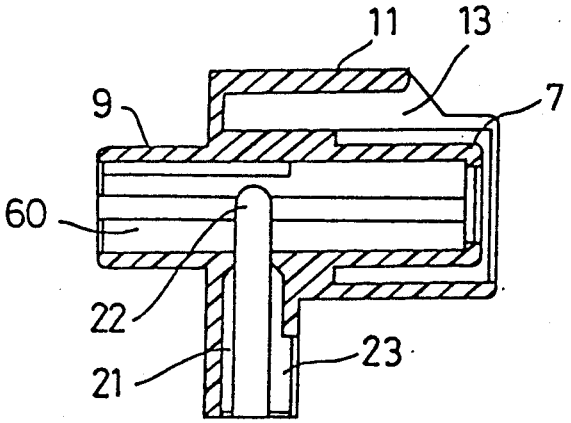
FIG. 12 is a sectional view taken along line 12—12 of FIG. 6.
Figure 13:
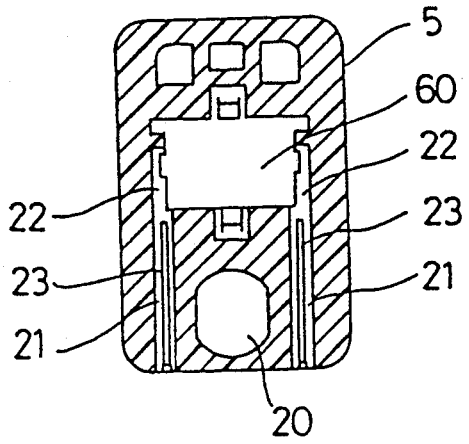
FIG. 13 is a sectional view taken along line 13—13 of FIG. 7.
Figure 14:
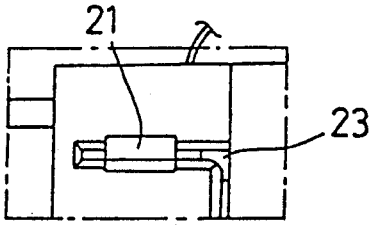
FIG. 14 is an enlarged view of a portion E of FIG. 9.

In FIG. 24, an electrical connector for a shielded cable 49 consists of a connector socket 1 and a connector plug 2.

In FIGS. 1-5, the connector socket 1 includes a socket housing 3; an electrical contact terminal assembly 4 fitted in the socket housing 3; and a ground plate 30 mounted on the socket housing 3.

In FIGS. 6-13, the socket housing 3 has a socket body 5 which is molded from a synthetic resin so as to have a rectangular outer tubular portion 6 and a rectangular inner tubular portion 7 both extending forwardly from a mounting portion 8 which extend in a direction perpendicular to the axis of the socket housing 3. A terminal housing tubular portion 9 extend rearwardly from the mounting portion 8 and communicates with the inner tubular portion 7, forming a terminal housing 60. A cutout 10 extend rearwardly from the upper front edge of the outer tubular portion 6. A cover 11 extends forwardly from the rear face 5*a* of the socket body 5 so as to cover the mid-to-rear portion of the cutout 10. An engaging projection 11*a* is formed on the inside of the cover 11.

The inner tubular portion 7 is made rectangular forming a plug receiving recess 12 between the outer and inner tubular portions 6 and 7. A locking recess 13 is provided between the inner tubular portion 7 and the cover portion 11. A slot 14 extends rearwardly from the front edge of the upper wall 7*a* of the inner tubular portion 7. A tongue member 15 extends forwardly from the rear end of the slot 14 and has an engaging projection 16 on the lower front portion. Similarly, a slot 17 extends rearwardly from the front edge of the lower wall 7*b*. A tongue portion 18 extends forwardly from the rear end of the slot 17 and has an engaging projection 19 on the upper front portion. A nut press-fit aperture 20 is formed on the mounting portion 8. A ground plate mounting section 61 is formed on the front face 8*a* of the mounting portion 8. A pair of insert holes 21 extend upwardly from the lower end of the mounting portion 8 across the press-fit aperture 20 and communicates with the terminal housing 60. An insert groove 22 is formed on opposite sides of the terminal housing 60 so as to communicate with the insert holes 21. A pair of slits 23 are formed on the front face 8*a* so as to communicate with the insert holes 21.

Figure 15:
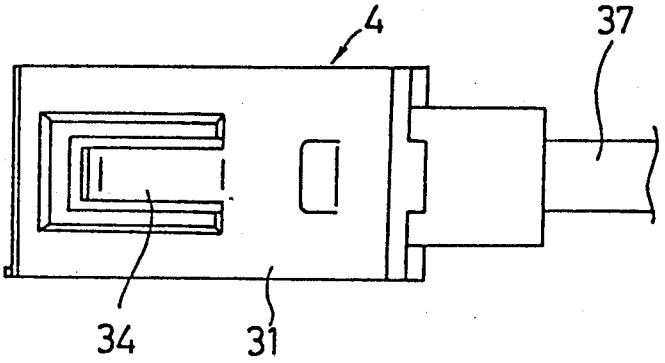
FIG. 15 is a side view of a contact terminal useful for the connector socket.
Figure 16:
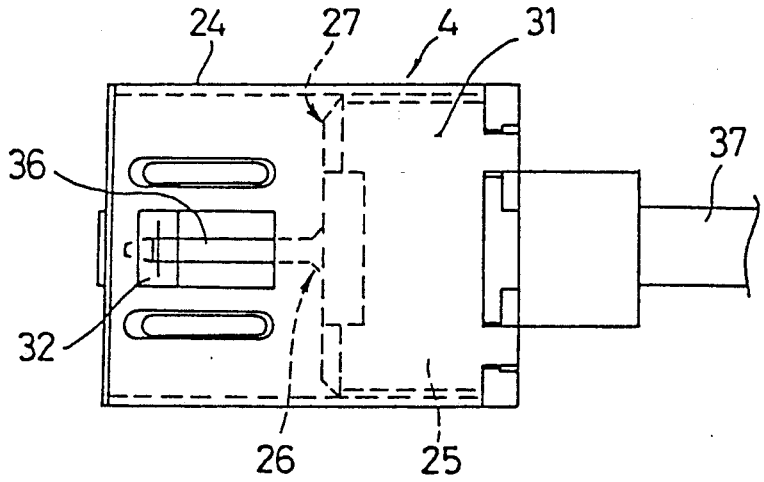
FIG. 16 is a top plan view of the contact terminal.
Figure 17:
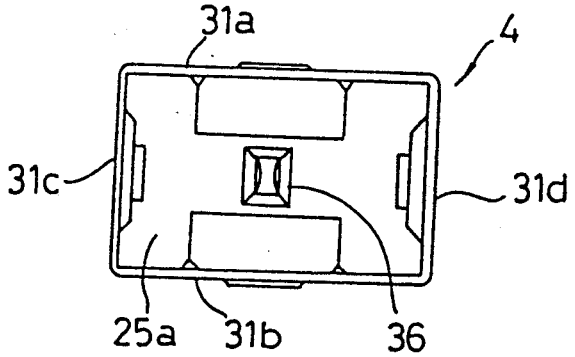
FIG. 17 is a front view of the contact terminal.

In FIGS. 15–17, the electrical contact terminal 4 includes an shield jacket 24 and a insulation assembly 27 fitted in the shield jacket 24, the insulation assembly 27 consisting of an insulating body 25 and an electrical contact element 26 with an end portion embedded in the insulation body. The shield jacket 24 has a jacket body 31 stamped and formed from sheet metal. A pair of engaging arms 32 extend rearwardly from the front portions of upper and lower faces 31*a* and 31*b*. A pair of engaging arms 34 extend forwardly from the middle portions of side faces 31*c* and 31*d*. The contact element 26 is embedded in the insulating body 25 such that the contact portion 36 is positioned in the center of a front face 25*e* of the insulating body 25. A shielded cable 37 is connected to the contact element 26.

Figure 18:
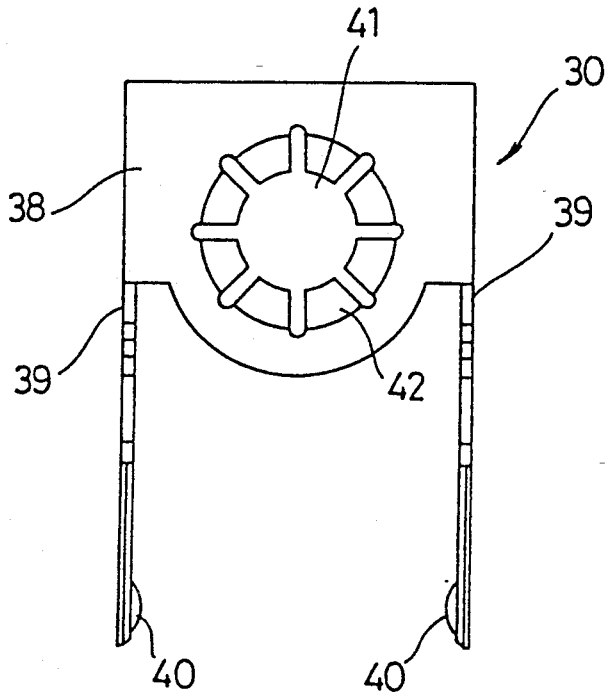
FIG. 18 is a front view of a ground plate useful for the connector socket.
Figure 19:
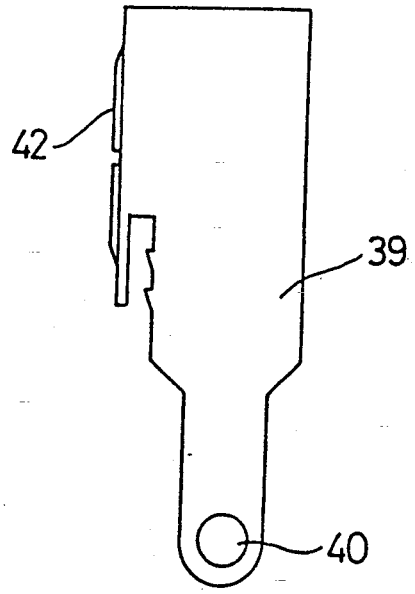
FIG. 19 is a side view of the ground plate.
Figure 20:
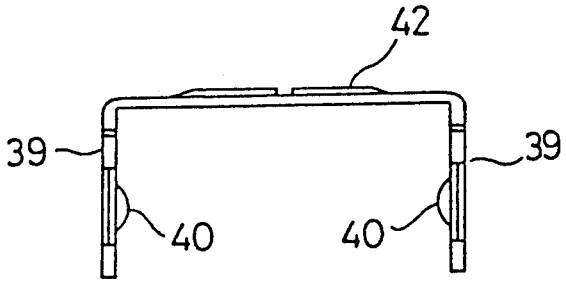
FIG. 20 is a top plan view of the ground plate.

FIGS. 18–20, the ground plate 30 has a front face 38 and a pair of shield terminals 39 which are bent at right angles with the front face 38 and have a semi-spherical contact portion 40 at the free end. An insert hole 41 is formed on the front face 38 and provided with a contact portion 42 which is composed of a number of lugs.

The connector socket 1 is made by mounting the ground plate 30 on the ground plate mounting section 61 of the housing 6, press-fitting a press-fit nut 43 into the nut press-fit aperture 20, and inserting the contact terminal 4 into the terminal housing 60 of the socket housing 6 from the back. More specifically, the ground plate 30 is mounted on the ground plate mounting section 61 with the shield terminals 39 and the base thereof inserted into the insert groove 22 from the insert hole 21 of the mounting section 8 and slits 23, respectively, while the insert aperture 41 is superimposed on the nut press-fit hole 20. The contact terminal assembly 4 is inserted into the terminal housing 60 through the terminal housing tubular portion 9, the engaging projections 16 and 19 of the arms 15 and 18 of the inner tubular portion 7 engage the engaging pieces 32 of the shield jacket 24, and the contact portions 40 of the shield terminals 39 are brought into contact with the side walls 31*a* and 31*b* of the shield jacket 24.

Figure 22:
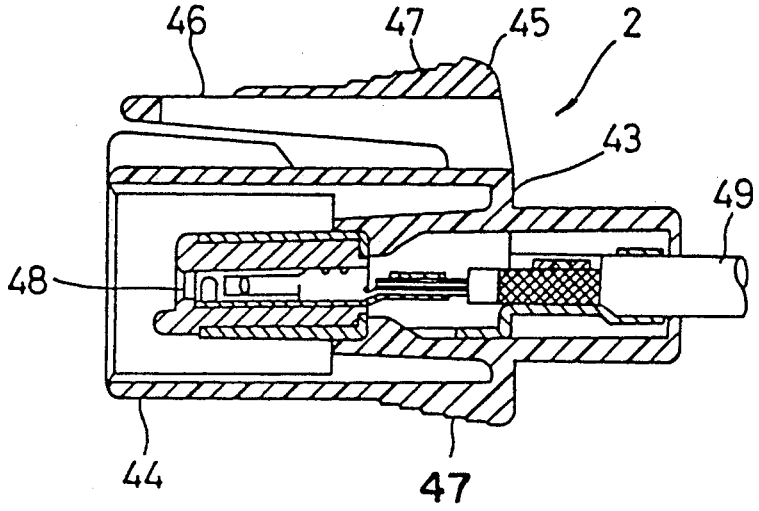
FIG. 22 is a longitudinal section of a connector plug.
Figure 23:
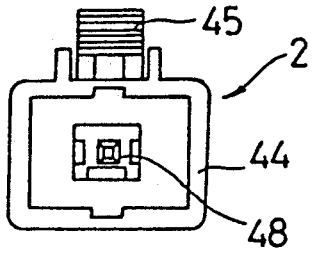
FIG. 23 is a front view of the connector plug.
Figure 25:
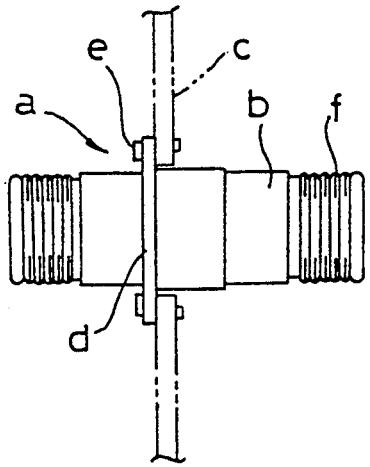
FIG. 25 PRIOR ART
FIG. 25 is a side view of a conventional electrical connector.

In FIGS. 22 and 23, the connector plug 2 includes a plug body 43 which has a rectangular front fitting portion 44. A lock arm 45 extend forwardly from the rear portion of the upper face of the plug body 43 and has a lock opening 46 on the front portion. The outside rear portion 47 of the lock arm 45 and the lower face rear portion 47' of the plug body 43 are corrugated for slip prevention purposes. The terminal 48 is provided within the plug body 43 and connected to a shield cable 49.

Figure 21:
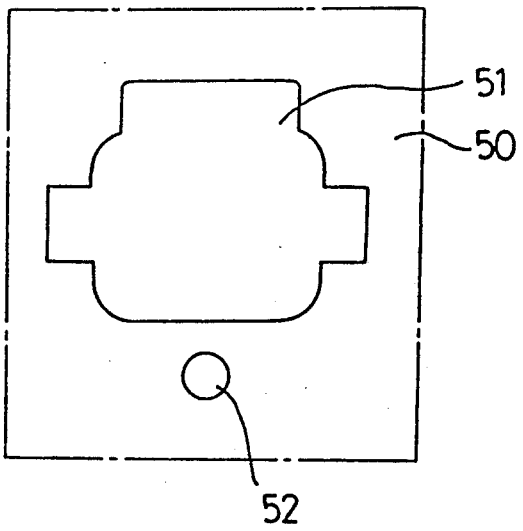
FIG. 21 is a front view of a metallic panel.

The connector socket 1 is attached to the metallic panel 50 of FIG. 21. The metallic panel 50 has an insert hole 51 into which the connector socket 1 is inserted, and a bolt aperture 52. That is, the connector socket 1 is attached to the metallic panel 50 by inserting the front portion of the connector socket 1 from the back such that the contact portion 42 of the ground plate 30 is brought into contact with the metallic panel 50, and tightening the bolt 52 into the press-fit nut 43 through the bolt aperture 52 and the mounting hole 20. Consequently, the shield jacket 24 of the contact terminal 4 is connected to the metallic panel 50 via the ground plate 30.

How to connect the connector plug 2 to the connector socket 1 will be described. The fitting portion 44 of the connector plug 2 is fitted into the fitting recess 12 of the connector socket 1 to bring the terminal 48 into contact with the contact portion 32 while the lock piece 45 of the connector plug 2 is fitted into the lock recess 13 of the connector socket 1 to engage the engaging projection 11*a* with the engaging hole 46.

With the above connector it is possible to discharge a source of noise or electromagnetic waves through the shield braid of the shielded cable 37, the shield jacket 24, the ground plate 30, and metallic panel 50.

The fitting portion 44 of the connector plug 2 is fitted into the fitting recess 12 of the connector socket 1 to bring the terminal 48 into contact with the contact portion 32 of the connector socket 1 for locking, thus making the connection and disconnection between the connector socket 1 and the connector plug 2 with a single touch. The strength against the forcible plugging in and out of the connector plug 2 into the connector socket 1 is increased because the contact terminal assembly 4 is housed in the socket housing 3, and the socket housing 3 is secured to the metallic panel 50 when the contact terminal assembly 4 is attached to the metallic panel 50. The lock recess 13 of the socket housing 3 which the lock piece 45 of the connector plug 2 engages make the connection of the connector plug 2 to the connector socket 1 strong and resistant to vibrations so that the connector is suitable for use in automotive electronic equipment.

As has been described above, the electrical connector according to the invention discharges electromagnetic wave noise via the shield braid, the shield jacket, the ground plate, and the metallic panel. The fitting portion of a connector plug is fitted into the fitting recess of a connector socket so that the terminal of the connector plug is brought into contact with the contact element of the connector socket while the lock arm of the connector plug is fitted in the lock recess of the connector socket for making a lock, thus making it possible to connect and disconnect the connector plug from the connector socket with a single touch.

Since the contact terminal assembly is placed within the socket housing, the socket housing is secured to a metallic panel to attach the contact terminal assembly to the metallic panel so that the strength against forcible plugging in and out of the connector plug from the connector socket is increased. Since the lock recess into which the lock arm of the connector plug is fitted for engagement is formed on the socket housing, the connection between the connector plug and socket is sufficiently strong to withstand vibrations and thus suitable for use in automobile electronic equipment.

We claim:

1. An electrical connector comprising:

a connector housing having a mounting portion to be mounted on a metallic panel or the like, and inner and outer tubular portions extending forwardly from said mounting portion to form a connector fitting recess between them;

a lock recess formed on said outer tubular portion for engagement with a lock piece of a mating connector;

a contact terminal assembly inserted into said inner tubular portion and having an electrically conductive shield jacket, said terminal assembly comprising an insulation body press-fitted in said shield jacket and an electrical contact element supported by said insulation body; and a ground plate mounted on said mounting portion such that a contact portion of a shield terminal of said ground plate is brought into contact with said shield jacket within said terminal housing.

* * * * *